US006308766B1

(12) United States Patent
Thurner

(10) Patent No.: US 6,308,766 B1
(45) Date of Patent: Oct. 30, 2001

(54) PROCESS FOR DIE-CASTING LIGHT-WEIGHT METALS

(75) Inventor: Hans Thurner, Baldham (DE)

(73) Assignee: Alusuisse Technology & Management Ltd., Neuhausen am Rheinfall (CH)

( * ) Notice: Subject to any disclaimer, the term of this patent is extended or adjusted under 35 U.S.C. 154(b) by 0 days.

(21) Appl. No.: 09/501,696

(22) Filed: Feb. 10, 2000

(30) Foreign Application Priority Data

Mar. 5, 1999 (EP) ..... 99810195

(51) Int. Cl.[7] ..... B22D 27/15; B22D 17/00

(52) U.S. Cl. ..... 164/61; 164/66.1; 164/113; 164/312; 164/457; 164/253

(58) Field of Search ..... 164/61, 55.1, 56.1, 164/62, 65, 66.1, 67.1, 113, 312, 253, 254, 256, 457

(56) References Cited

U.S. PATENT DOCUMENTS

| | | | | |
|---|---|---|---|---|
| 3,382,910 | * | 5/1968 | Radtke et al. | 164/55 |
| 3,744,546 | * | 7/1973 | Miki et al. | 164/55 |
| 4,431,047 | * | 2/1984 | Takeshima et al. | 164/253 |
| 4,463,793 | * | 8/1984 | Thurner | 164/155 |
| 5,076,344 | * | 12/1991 | Fields et al. | 164/457 |
| 6,024,158 | * | 2/2000 | Gabathuler et al. | 164/61 |
| 6,176,294 | * | 1/2001 | Kuramasu et al. | 164/61 |

FOREIGN PATENT DOCUMENTS

| | | | | |
|---|---|---|---|---|
| 55-8382 | | 1/1980 | (JP) . | |
| 55008382-A | * | 1/1980 | (JP) | B22D/17/14 |
| 58-3766 | | 1/1983 | (JP) . | |
| 1134289-A | * | 1/1985 | (SU) | B22D/17/00 |
| 1134289 | | 1/1985 | (SU) . | |

OTHER PUBLICATIONS

Patent Abstracts of Japan, vol. 004, No. 033 (M–003), Mar. 21, 1980.

Patent Abstracts of Japan, vol. 007, No. 074 (M–203), Mar. 26, 1983.

Database WPI Section Ch, Week 8532, Derwent Publications Ltd., London, GB; Class M22, AN 85–195087 XP002110421.

* cited by examiner

*Primary Examiner*—Tom Dunn
*Assistant Examiner*—Kevin P. Kerns
(74) *Attorney, Agent, or Firm*—Bachman & LaPointe, P.C.

(57) ABSTRACT

A process for die-casting aluminum and aluminum alloys is such that the molten metal is introduced into a filling chamber and injected from the filling chamber into a mold cavity by a piston. The mold cavity is evacuated in advance, after which it is flooded with oxygen. After flooding with oxygen and before injecting the molten metal into it, the mold cavity is again evacuated. Finally, the molten metal is injected into the hollow mold cavity. The process enables die-cast parts to be produced with low tendency to forming pores and blisters.

6 Claims, 1 Drawing Sheet

PROCESS FOR DIE-CASTING LIGHT-WEIGHT METALS

BACKGROUND OF THE INVENTION

The present invention relates to a process for die-casting light-weight metals, in particular aluminum and aluminum alloys, in which the molten metal is charged into a filling chamber and injected from the filling chamber into a hollow mold cavity by means of a piston.

In a known die-casting process molten metal is introduced into a filling chamber and, by means of a piston, injected from the filing chamber into a hollow mold cavity of a die-casting machine. The greater part of the gases such as e.g. air or water vapor is expelled from the mold cavity by the metal injected into the mold. In variants of this process, the mold cavity is evacuated in advance down to a residual pressure of approx. 200 to 500 mbar and, in special vacuum die-casting processes, even to a residual pressure of less than 100 mbar.

Molds for die-casting thin walled and large surface area or complex shaped die-cast parts exhibit narrow regions which hinder the melt and make it practically impossible to remove the gases from the mold cavity. On evacuating the mold before filling it is not possible to achieve a high vacuum, because of the lack of air tightness and due to the cost and time involved. Although the occlusion of gases in the form of pores or blisters is much less pronounced with vacuum die-casting than with conventional die-casting, the number of these defects in the die-cast part is still too high for the use of such parts as safety components in automobile manufacture, because of inadequate mechanical properties.

In a die-casting process for casting aluminum parts known by the name Pore Free Die-casting (PFD), before injecting the metal into the mold cavity, the latter is flooded with oxygen, to a pressure above atmospheric pressure so that the gases in the mold cavity are replaced by oxygen. The oxygen fed to the mold cavity flows through narrow gaps and regions and, after a certain duration of flooding, the greater part of the gases previously in the mold cavity are expelled from the mold cavity and it is possible to prevent atmospheric gases from re-entering the mold. On subsequently injecting of molten aluminum into the mold, the aluminum reacts with oxygen to form $Al_2O_3$ which remains as a dispersion of fine particles in the die-cast part without noticeably altering its properties.

It has been found, however, that even on maintaining a pressure in the mold cavity above the atmospheric pressure, it is practically impossible to completely remove the gases from the interior of a die-casting mold by flooding it with oxygen. Residual gases often remain for an extended period in regions that are difficult to flood. Water-based separating agents require, for example, a certain amount of time until they dry up completely under relatively high atmospheric pressure. In the case of die-casting molds for manufacturing die-cast pacts of relatively complicated shape, some regions are difficult to reach with oxygen with the result that residual gases such as air or water vapor are not replaced by oxygen, but remain as such in the mold cavity. During die-casting, these residual gases and water vapor form separating agents remaining in the mold cavity and become trapped in the metal form pores there and, as a result of subsequent heat treatment such as e.g. solution treatment lead to blisters at the surface. Due to these blisters, many die-casting parts cannot be heat treated.

Accordingly, it is a principle object of the present invention to provide a process for die-casting as described above wherein the occlusion of gases is reduced considerably and as a result the above mentioned problems of formation of pores and blisters in die-cast parts can be prevented.

SUMMARY OF THE INVENTION

The foregoing object is achieved by way of the present invention wherein the mold cavity is evacuated in advance, hereinafter referred to as pre-evacuating, then flooded with oxygen and before injecting with the molten metal, the mold is again evacuated and finally the molten metal is injected into the mold cavity.

The essential aspect of the invention lies in the combination of the known vacuum die-casting process with the PFD process. In accordance with the process of the present invention, the above mentioned disadvantages of the individual processes can be eliminated in a simple manner. By pre-evacuating the mold cavity the residual amount of air and water vapor can be substantially reduced, so that the subsequent flooding of the mold cavity with oxygen leads to practically complete removal of the residual gases. With the process according to the invention excellent results are obtained even with relatively low vacuum.

In order to achieve optimum results with respect to the formation of pores and blisters, the pre-evacuation of the mold cavity, prior to flooding with oxygen, effects a residual pressure of less than 100 mbar.

On flooding the mold cavity with oxygen, a pressure above atmospheric pressure is usefully maintained.

In order to prevent gases and water vapor from flowing back into the mold cavity, it may be useful to maintain an oxygen atmosphere around the die. In this way, should any leaks occur, oxygen instead of air and water vapor would be sucked back into the mold cavity.

With the process according to the invention two versions are possible:

1. The steps of pre-evacuation and flooding with oxygen are performed before filling the filling chamber with molten metal.
2. The molten metal is poured into the filling chamber and the filling opening closed off with the piston. Subsequently all three steps that is, pre-evacuation, flooding with oxygen and again evacuating the mold cavity are carried out one after the other during a first filling phase which lasts until the molten metal enters the mold space. This second version can be employed especially with large die-casting machines as these facilitate longer first filling phases.

With the process according to the invention it is possible to manufacture die-cast parts out of aluminum or an aluminum alloy with a content of enclosed gases of less than 1 $cm^3$ enclosed gases per 100 g aluminum. Such die-cast parts have excellent mechanical properties and may be employed for functional structure parts such as safety parts in automobile manufacture. Furthermore, the die-cast parts manufactured according to the invention can be heat treated or welded without danger of blisters forming due to enclosed gases.

A particularly advantageous application of the process according to the invention is achieved by the combination of the MFT or HQC process i.e. with the die-casting process and devices such as described in patent documents EP-A-0759825 and DE-C-3002886.

BRIEF DESCRIPTION OF THE DRAWINGS

Further advantages, features and details of the invention are revealed in the following description of the process and with the aid of the drawing which shows schematically in FIG. 1 a die-casting machine suitable for carrying out the process according to the invention.

DETAILED DESCRIPTION

Figure 1:
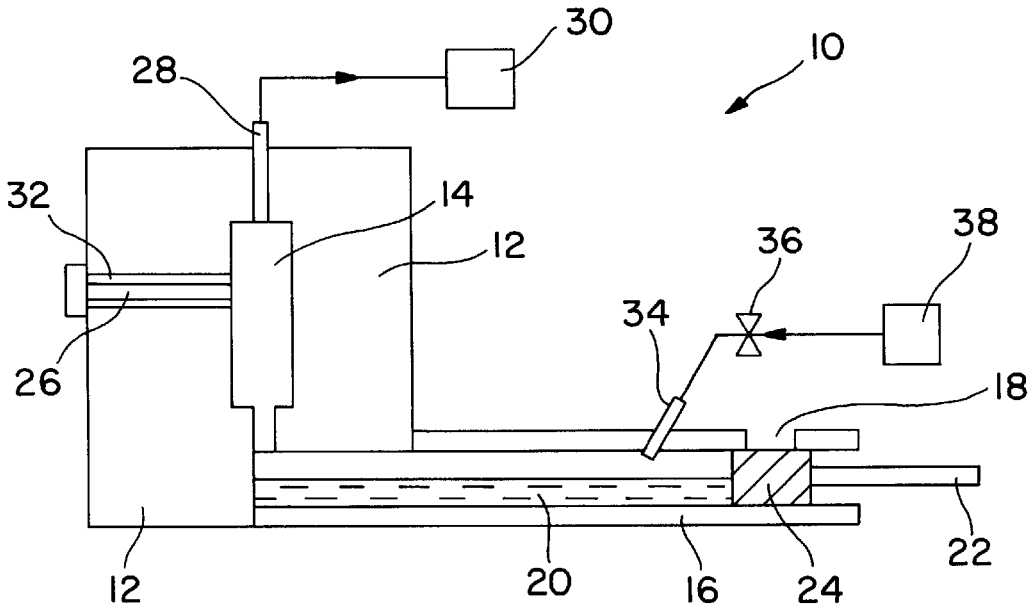

A die-casting machine 10, shown in FIG. 1, comprises a die-casting mold 12 with hollow mold cavity 14 which is connected to a filling chamber 16. Molten metal 20 is introduced into the filling chamber 16 via an inlet opening 18 and injected into the mold cavity 14 by a piston 24 actuated by a piston rod 22. After filling the mold cavity 14 with molten metal 20, this is cooled and solidifies with a shape defined by the inner surface of the mold 12. After cooling, a die-cast part made this way is ejected from the mold 12 by means of ejection pins 26 in the mold cavity 14.

A vacuum suction pipe 28 connects the mold cavity 14 to a vacuum pump 30. During evacuation of the mold cavity 14 via the suction pipe 28 there is a danger of air and water vapor entering the mold cavity 14 via the ejection pins 26. For that reason a sealing means 32 is provided between the ejection pins 26 and their alignment and between the two halves of the mold 12. Also the inlet opening 18 to the filling chamber 26 is closed off by the piston 24 so that no air and no water vapor can enter the interior of the filling chamber 16 through the inlet opening 18.

In order to flood the filling chamber 16 and the mold cavity 14 with oxygen, after evacuation, an oxygen nozzle 34 is opened to allow oxygen to enter the interior of the filing chamber 16 and from there the mold cavity 14. The oxygen nozzle 34 is connected to an oxygen source 38 via a regulating valve 36.

When the mold cavity 14 has been evacuated via the vacuum suction pipe 28, air and water vapor are prevented from entering the mold cavity 14 and the filing chamber 16 connected to it. Even with complicated configurations of mold cavity 14 residual gases can be removed from concealed parts of the mold cavity 14 by choosing suction rates in the range of 500 to 800 mbar/sec.

Evacuation is usefully maintained for a time (t) of 1 to 2 seconds, the inlet opening 18 of course being closed off by the piston 24. Compared with conventional vacuum die casting processes in which the evacuation lasts for less than 1 second, the evacuation time in the process according to the invention is somewhat longer. Because of the longer evacuation interval a vacuum of usefully less than 100 mbar is created in the mold cavity 14. Water vapor originating from separating agents and adhering to the inner surface of the mold 12, evaporates from this surface and is transported out of the mold cavity 14.

Evacuating the mold cavity 14 leads to more effective removal of water vapor than simply flooding it with oxygen as the gas then flows faster into the mold cavity 14. If however, the mold cavity 14 is evacuated to an insufficient vacuum level viz., above approx. 100 mbar, a relatively large amount of residual gas remains there. A large fraction of the residual gas remaining in the mold cavity 14 is then not replaced by oxygen, but instead often remains trapped in the casting.

After pre-evacuating, oxygen is introduced into the mold cavity 14 via the oxygen nozzle 34. The feed of oxygen is preferably maintained for 3 to 4 seconds, until the gases and the oxygen escape from the mold cavity 14 through the two halves of the mold 12.

As the oxygen flows into the previously evacuated mold cavity 14, the oxygen flows at high speed into those narrow parts of the mold cavity 14 so that the greater part of water vapor originating from the separating agent is washed out by the oxygen.

Figure 2:
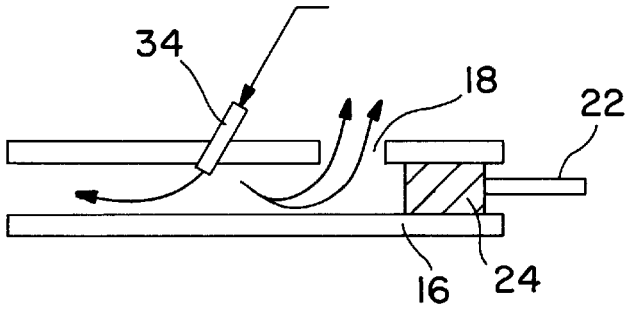
FIG. 2 the filling chamber of the die-casting machine in FIG. 1 during flooding with oxygen.
Figure 3:
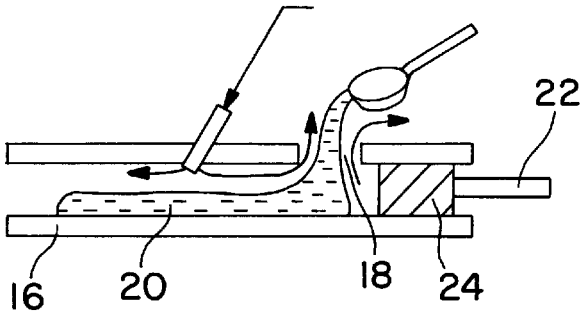
FIG. 3 the filling chamber of the die-casting machine in FIG. 1 during filling with molten metal.

The piston 24 moves back to the opening of the filling inlet 18, whereby the feed of oxygen is maintained As soon as the inlet opening 18 is free, oxygen also flows out through the inlet opening 18, as shown in FIG. 2. The outflow of oxygen effectively prevents air and water vapor from entering the filling chamber 16 through the inlet opening 18.

After the inlet 18 has been opened, molten metal 20 is poured into the filing chamber 16. During the filing process oxygen continues to flow out of the inlet 18. Consequently, air and water vapor are prevented from entering the filling chamber 16 while it is being filled with molten metal 20.

In order to prevent thermal shock and to improve productivity, the mold 12 is preheated preferably to a temperature of approximately 150 to 200° C.

When an adequate amount of molten metal 20 for a casting cycle has been introduced into the filling chamber 16, the inlet opening 18 is closed off with the molten metal 20. As oxygen can no longer enter via the inlet opening 18, the feed of oxygen is stopped.

The gases such as air and water vapor having been completely removed from the mold cavity 14 and from the filling chamber, the piston rod 22 with the piston 24 is moved forward and the molten metal 20 injected into the mold cavity 14. The mass of metal filling the mold cavity 14 is cooled and solidifies in the shape corresponding to that of the mold cavity.

As already mentioned, in one version of the process according to the invention, in particular with large die casting machines, the molten metal 20 can be introduced in a first step into the filling chamber 16 and the inlet opening 18 closed off by the piston 24. Following that all three steps, that is, pre-evacuation, flooding with oxygen and again evacuating, are carried out one after the other during the first filling phase of the die-casting process i.e. until the molten metal enters the mold cavity.

What is claimed is:

1. A process for die-casting light-weight metals, wherein the molten metal is introduced into a filling chamber and injected from the filling chamber into a mold cavity by means of a piston, said process comprising:

a) pre-evacuating the mold cavity;

b) flooding the evacuated mold cavity with oxygen;

c) further evacuating the mold cavity; and d) injecting molten metal into the mold cavity.

2. A process according to claim 1, wherein the mold cavity is pre-evacuated to a residual pressure of less than 100 mbar prior to flooding with oxygen.

3. A process according to claim 1, wherein the mold cavity is flooded with oxygen to a pressure in excess of atmospheric pressure and is maintained at said pressure for a time (t).

4. A process according to claim 1, wherein during evacuation of the mold cavity, an atmosphere of oxygen is maintained around the mold in order to prevent gases and water vapor from flowing back into the mold cavity.

5. A process according to claim 1, wherein the steps of pre-evacuation, flooding with oxygen and further evacuating, are cared out prior to introducing molten metal into the filling chamber.

6. A process according to claim 1, further including introducing molten metal into the filling chamber and thereafter the steps of pre-evacuating, flooding and further evacuating are carried out during a first filling phase which lasts until the molten metal enters the mold cavity.

* * * * *